US012704298B2

(12) United States Patent
Shelander

(10) Patent No.: US 12,704,298 B2
(45) Date of Patent: Aug. 11, 2026

(54) SIMULTANEOUS HEATING AND CHILLING HEAT PUMP SYSTEM

(71) Applicant: Ace Machine Design Inc., Commerce, CA (US)

(72) Inventor: Agustus Berman Shelander, Joshua Tree, CA (US)

(73) Assignee: Ace Machine Design Inc., Commerce, CA (US)

( * ) Notice: Subject to any disclaimer, the term of this patent is extended or adjusted under 35 U.S.C. 154(b) by 107 days.

(21) Appl. No.: 18/421,883

(22) Filed: Jan. 24, 2024

(65) Prior Publication Data

US 2024/0247840 A1 Jul. 25, 2024

Related U.S. Application Data

(60) Provisional application No. 63/440,846, filed on Jan. 24, 2023.

(51) Int. Cl.

| | |
|---|---|
| ***F25B 25/00*** | (2006.01) |
| ***F25B 13/00*** | (2006.01) |
| ***F25B 40/02*** | (2006.01) |

(52) U.S. Cl.

CPC ..... *F25B 13/00* (2013.01); *F25B 25/005* (2013.01); *F25B 40/02* (2013.01)

(58) Field of Classification Search

CPC .... F25B 13/00; F25B 1/00; F25B 7/00; F25B 25/005; F25B 27/02; F25B 40/02

See application file for complete search history.

(56) References Cited

U.S. PATENT DOCUMENTS

| | | | | |
|---|---|---|---|---|
| 2013/0145780 | A1* | 6/2013 | Parsonnet | F25B 1/00 62/115 |
| 2021/0018234 | A1* | 1/2021 | Lingrey | F25B 41/26 |
| 2021/0148614 | A1* | 5/2021 | Melink | F24D 17/0005 |

* cited by examiner

*Primary Examiner* — Miguel A Diaz

(74) *Attorney, Agent, or Firm* — Canady & Lortz LLP; Bradley K. Lortz

(57) ABSTRACT

A heat pump system for supplying a heated process fluid to a heated process and a chilled process fluid to a chilled process, including a compressor to compress a refrigerant, a hot heat exchanger to receive the heated process fluid, a cold heat exchanger to receive the chilled process fluid and an expansion device (22), wherein the compressor, hot heat exchanger, cold heat exchanger, and expansion device circulate the refrigerant in a serial loop such that the hot heat exchanger can impart heat energy into the heated process fluid and concurrently the cold heat exchanger can absorb heat energy from the chilled process fluid.

20 Claims, 11 Drawing Sheets

SIMULTANEOUS HEATING AND CHILLING HEAT PUMP SYSTEM

CROSS-REFERENCE TO RELATED APPLICATIONS

This application claims the benefit of U.S. Provisional Application No. 63/440,846, filed Jan. 24, 2023, hereby incorporated by reference in its entirety.

TECHNICAL FIELD

The present invention relates generally to heat pump systems, and more particularly to such used in processes employing simultaneous heating and chilling.

BACKGROUND ART

Many industrial processes require both heating and cooling, often with similar thermal loads. For example. pasteurization usually uses steam to rapidly heat a food product to a specified temperature for a short amount of time before rapidly cooling it again, similarly distillation processes require large amounts of heat energy to evaporate some fraction of a solution before promptly removing that heat to recondense that fraction. In both cases large amounts of heat energy must be used and promptly dissipated often with significant additional energy requirements for chilling. By using the waste heat from the cooling process for heating the total energy requirement can be greatly reduced often by 80% or more. There are many other processes that also require both heating and cooling and industrial facility's that have separate process running concurrently where heat removed form one part of the process for facility use can be used in another part to rescue energy concussion. There are many challenges to efficiently using heat in this manor, principally, obtaining the correct temperatures for both chilling and heating and overcoming variabilities in the loads on the hot and cold side. The present invention provides a solution to both challenges.

OBJECT AND SUMMARY OF THE INVENTION

Accordingly, it is an object of the present invention to provide a simultaneous heating and chilling heat pump system.

Briefly, one preferred embodiment of the present invention is a heat pump system for supplying a heated process fluid to a heated process and a chilled process fluid to a chilled process, including a compressor to compress a refrigerant, a hot heat exchanger to receive the heated process fluid, a cold heat exchanger to receive the chilled process fluid, and an expansion device, wherein the compressor, the hot heat exchanger, the cold heat exchanger, and the expansion device circulate the refrigerant in a serial loop such that the hot heat exchanger can impart heat energy into the heated process fluid and concurrently the cold heat exchanger can absorb heat energy from the chilled process fluid.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE FIGURES

The purposes and advantages of the present invention will be apparent from the following detailed description in conjunction with the appended figures of drawings in which.

In the various figures of the drawings, like references are used to denote like or similar elements or steps.

DETAILED DESCRIPTION OF THE INVENTION

Figure 1:
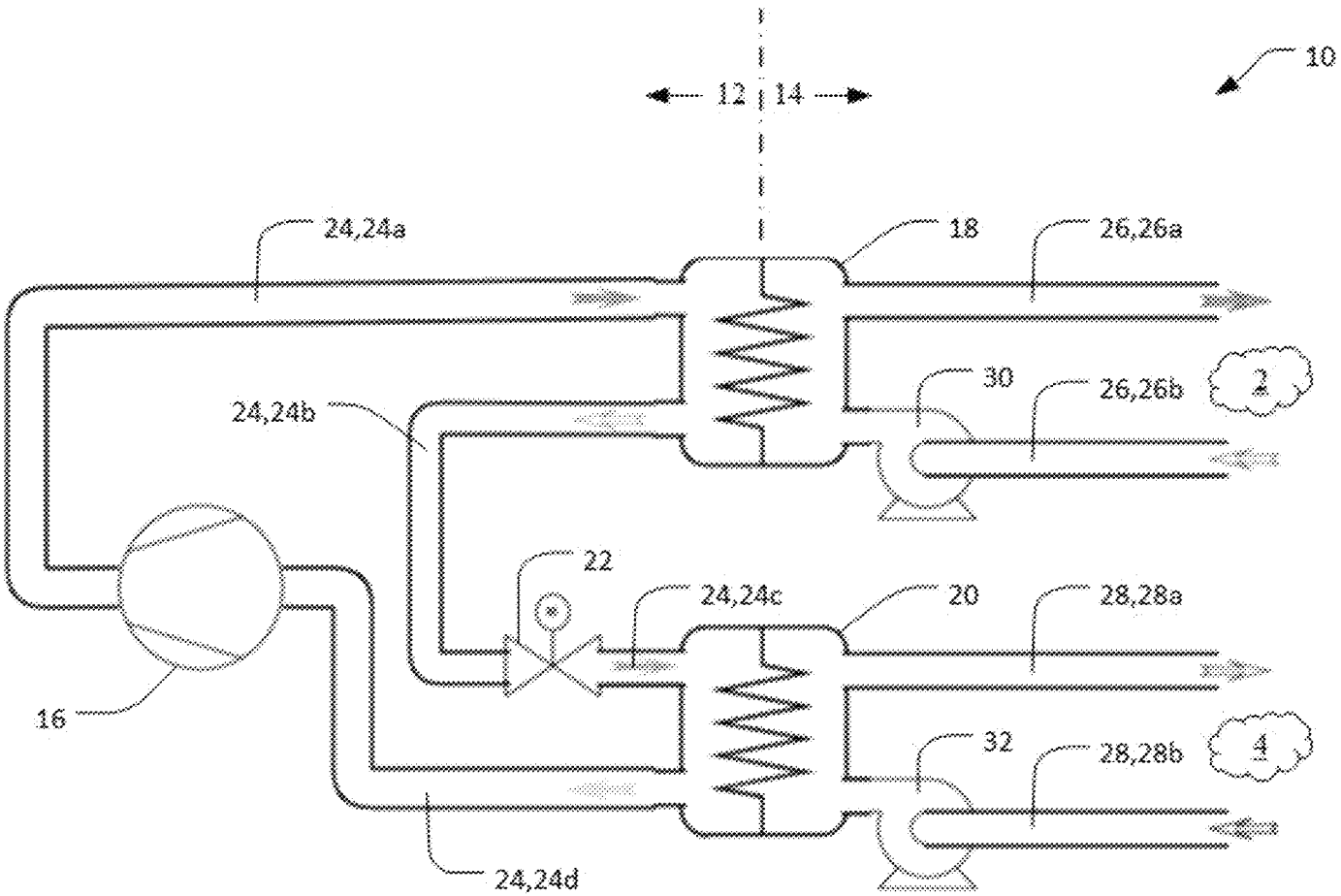
FIG. 1 is a schematic diagram of a first embodiment of a heat pump system in accord with the present invention.

A preferred embodiment of the present invention is a simultaneous heating and chilling heat pump system. As illustrated in the various drawings herein, embodiments of the invention are depicted by the general reference character 10.

The present invention relates to heat pump systems for simultaneously creating a hot fluid and a cold fluid for use in any desired processes. For example, distillation processes may use heat for boiling and cooling for condensation with almost identical thermodynamic loads. The present invention may therefore be added to new or existing systems to provide both heating fluid and cooling fluid with drastically reduced power consumption.

As shown in FIG. 1, the inventive heat pump system 10 serves a (first) heated process 2 and a (second) chilled process 4. These are stylistically shown as clouds in the figures. The heat pump system 10 has two main sides. One is a working or compressor side 12, shown to the left in the figures, and the other is a process side 14 shown to the right in FIGS. 1-5. In FIGS. 6-11 the process side 14 is not shown since it remains the same as in FIG. 1.

The main elements of the heat pump system 10, common in all embodiments shown in the figures, are a compressor 16, a hot heat exchanger 18, a cold heat exchanger 20, and a main expansion device 22. Also included in FIG. 1 only are a refrigerant 24, a heated process fluid 26 (such as water), and a chilled process fluid 28 (such as glycol). [To avoid confusion different references for fluids are used in each figure.]

The compressor 16, the main expansion device 22, and the refrigerant 24 are in the compressor side 12 of the heat pump system 10. The heated process fluid 26 and the chilled process fluid 28 are in the process side 14. The process side 14 may additionally include an optional pump 30 to move the heated process fluid 26 and an optional pump 32 to move chilled process fluid 28. The hot heat exchanger 18 and the cold heat exchanger 20 each have portions in both the compressor side 12 and the process side 14 of the heat pump system 10.

In FIG. 1 the refrigerant 24 (generically) includes refrigerant portions 24*a-d* (specifically; discussed presently). The heated process fluid 26 (generically) has heated process fluid portions 26*a-b*, wherein the heated process fluid portion 26*a* is a fluid that the heat pump system 10 provides to the heated process 2 and the heated process fluid portion 26*b* is a fluid that the heat pump system 10 receives from the heated process 2. The chilled process fluid 28 (generically) has chilled process fluid portions 28*a-b*, wherein the chilled process fluid portion 28*a* is a fluid that the heat pump system 10 provides to the chilled process 4 and the chilled process fluid portion 28*b* is a fluid that the heat pump system 10 receives from the chilled process 4.

Proceeding from left to right in FIG. 1, the compressor 16 compresses the refrigerant 24, causing it to heat and become the refrigerant portion 24*a* (hot). The refrigerant portion 24*a* is passed through the compressor side 12 of the hot heat exchanger 18, where it gives up heat energy to and heats the heated process fluid 26. During this, the refrigerant 24 cools to a lower temperature and becomes the refrigerant portion 24*b*. As the refrigerant portion 24*b* exits the hot heat exchanger 18 it typically condenses to a liquid state. The refrigerant 24 then passes through the main expansion device 22, typically changing to a cold liquid and gas mixture, and becomes the refrigerant portion 24*c* (cold). The refrigerant portion 24*c* then passes through the compressor side 12 of the cold heat exchanger 20 and becomes the refrigerant portion 24*d* before being returned to the compressor 16. Accordingly, in FIG. 1 the refrigerant 24 circulates in a serial loop through the compressor 16, the hot heat exchanger 18, the cold heat exchanger 20, and the main expansion device 22.

Concurrently, the heated process fluid 26 is circulated through the process side 14 of the hot heat exchanger 18. During this the heated process fluid 26 receives heat energy, is heated to a higher temperature, and becomes the heated process fluid portion 26*a* (i.e., a heated supply). The heated process fluid portion 26*a* thus provides heat energy to the heated process 2, giving up to it some of the heat energy it contains. In the heated process 2 the heated process fluid 26 (typically) is cooled to a lower temperature and is returned to the hot heat exchanger 18 as the heated process fluid portion 26*b* (i.e., a cool return).

Also concurrently, the chilled process fluid 28 is circulated through the process side 14 of the cold heat exchanger 20. During this the chilled process fluid 28 gives up heat energy, is cooled to a lower temperature, and becomes the chilled process fluid portion 28*a* (i.e., a cold supply). The chilled process fluid 28 thus extracts heat energy from the chilled process 4, extracting from it some of the heat energy it contains. In the chilled process 4 the chilled process fluid 28 (typically) is heated to a higher temperature and is returned to the cold heat exchanger 20 as the chilled process fluid portion 28*b* (i.e., a hot return).

Figure 2:
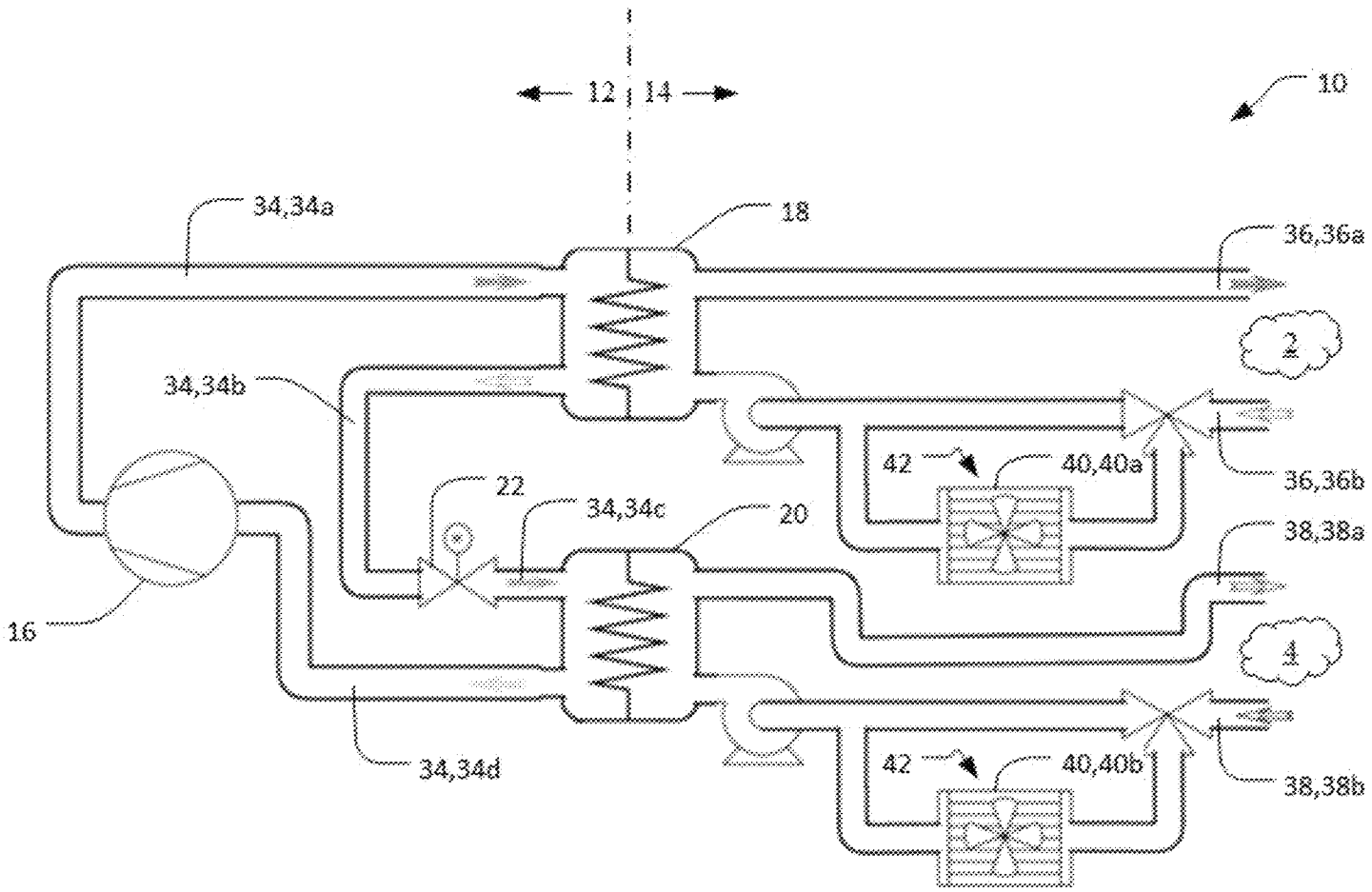
FIG. 2 is a schematic diagram of a heat pump system, wherein one or two (as shown) additional heat exchangers are added to the process side of the embodiment of FIG. 1.

FIG. 2 is a schematic diagram of an alternate heat pump system 10 in accord with the present invention, wherein alternate references for some elements are used to avoid confusion. Specifically, a refrigerant 34 (refrigerant portions 34*a-d*), a heated process fluid 36 (heated process fluid portions 36*a-b*) (such as water), and a chilled process fluid 38 (chilled process fluid portions 38*a-b*) (such as glycol) replace the equivalent elements in FIG. 1.

The (first) heated process 2 is unlikely to demand exactly the amount of heat as the (second) chilled process 4 generates, plus the heat created by the heat pump system 10, so to maintain the desired temperatures it typically will be necessary to add one or two (as shown) additional heat exchangers 40,40*a-b* to dissipate excess heat or to absorb additional heat to make up a deficit. For example, as depicted in FIG. 2, excess heat may be rejected to a circulating fluid 42 (such as air) via the heat exchanger 40*a* connected to the returning heated process fluid portion 36*b*. Additional heat may also be gained through direct heating or by absorbing it from the circulating fluid 42, via the heat exchanger 40*b* connected to the returning chilled process fluid portion 38*b*. The heat exchangers 40*a-b* (here and elsewhere in the figures) are depicted as liquid to air radiators (hence multiple tubes and a fan), but this is not a requirement and other types of heat exchangers are suitable.

Figure 3:
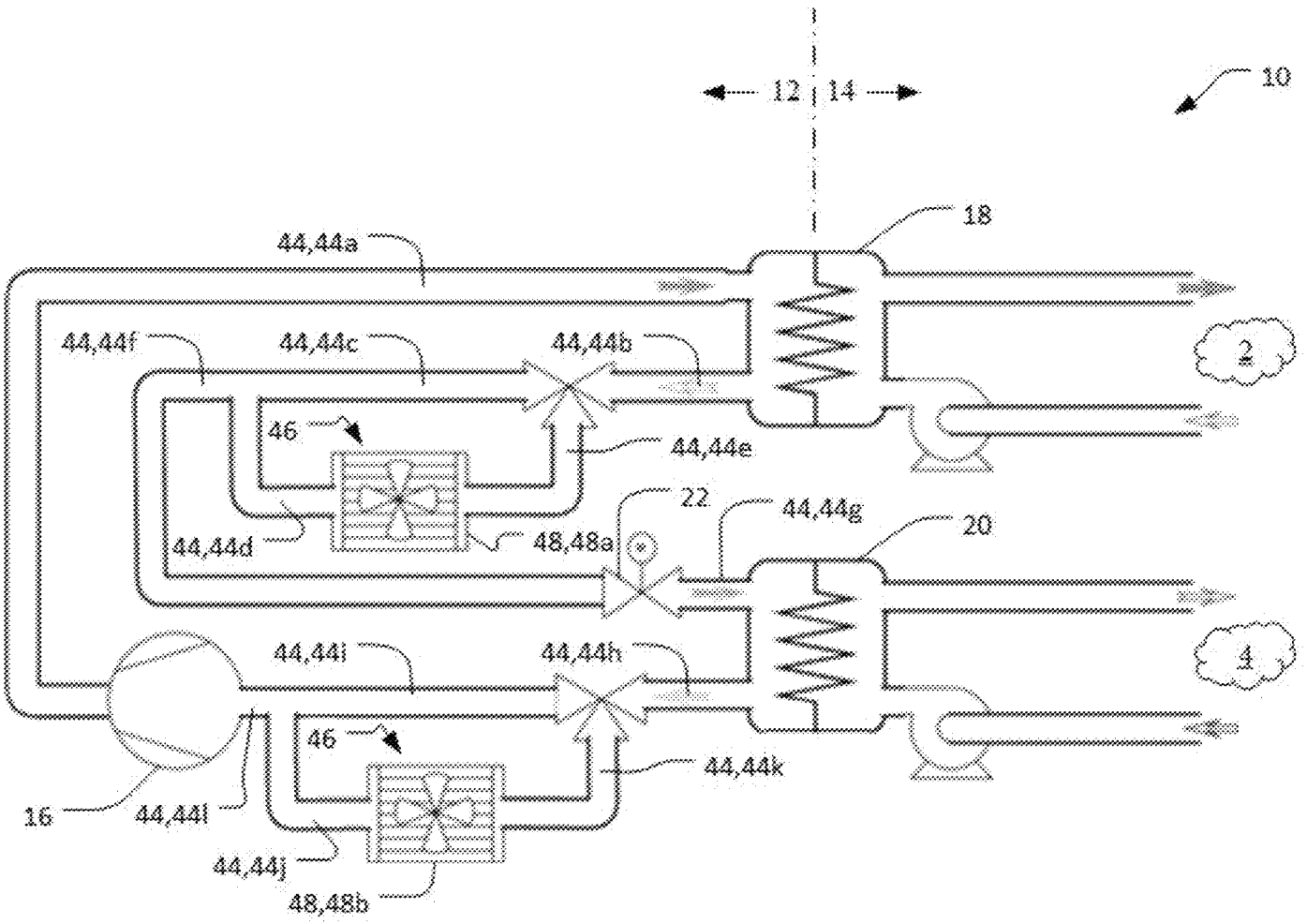
FIG. 3 is a schematic diagram of an alternate heat pump system, wherein one or two (as shown) additional heat exchangers are added to the compressor side of the embodiment of FIG. 1.

FIG. 3 is a schematic diagram of an alternate heat pump system 10 in accord with the present invention, wherein alternate references for some elements are used to avoid confusion. Specifically, a refrigerant 44 (refrigerant portions 44*a-l*), and a circulating fluid 46 (such as air; the circulating fluid 46 may be the same as the circulating fluid 42).

As depicted in FIG. 3, excess heat may be rejected to the circulating fluid 46 via an additional heat exchanger 48,48*a* connected to the refrigerant portion 44*b*. Additional heat may also be gained through direct heating or by absorbing it from the circulating fluid 46, via an additional heat exchanger 48,48*b* connected to the refrigerant portion 44*h*.

Figure 4:
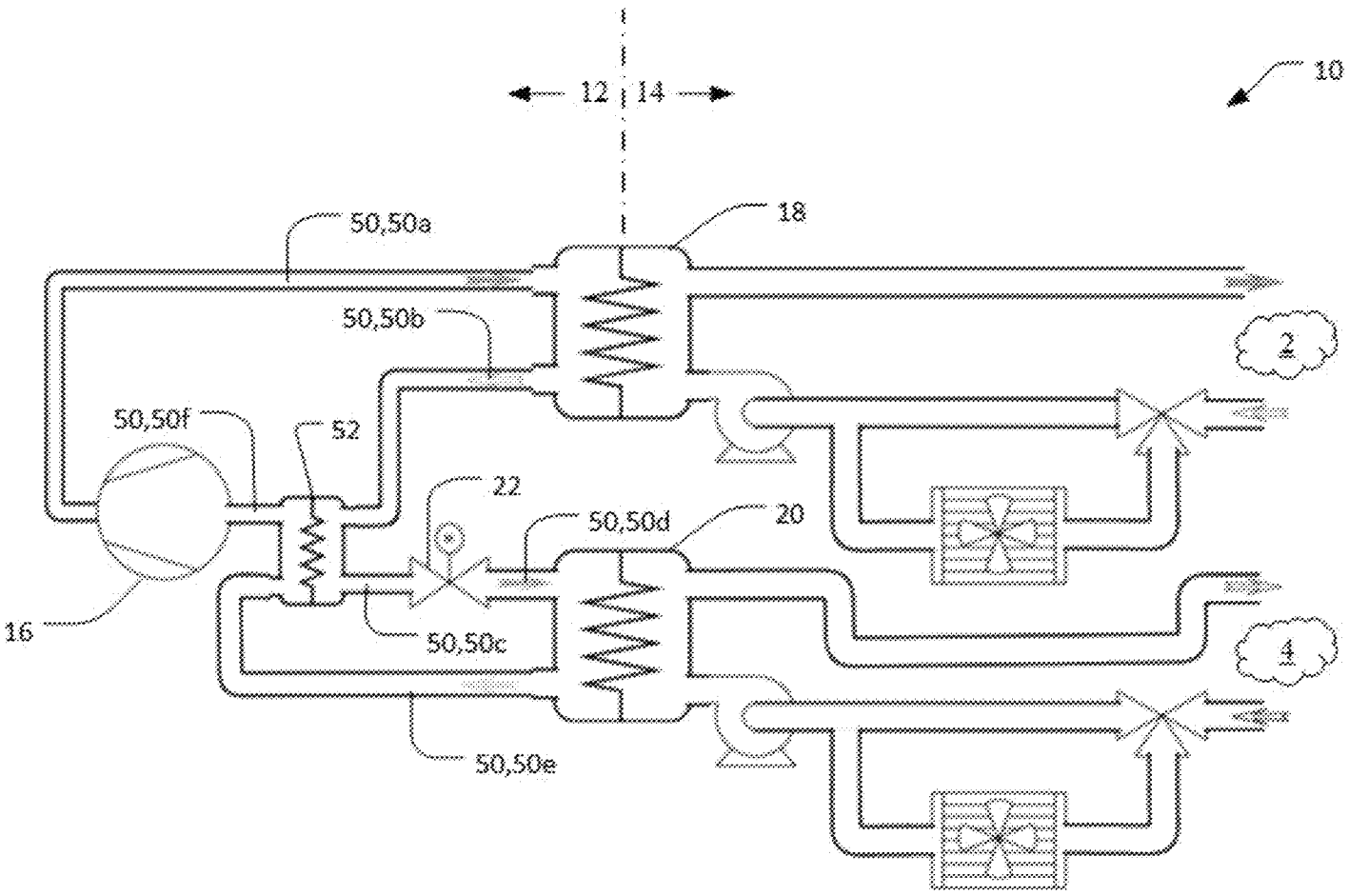
FIG. 4 is a schematic diagram of a heat pump system, wherein a sub-cooling heat exchanger is added to the compressor side of the embodiment(s) of FIG. 2.

FIG. 4 is a schematic diagram of an alternate heat pump system in accord with the present invention, wherein alternate references for some elements are used to avoid confusion. Specifically, a refrigerant 50 (refrigerant portions 50*a-f*) replace the equivalent elements in the prior figures. Here a sub-cooling heat exchanger 52 is added to the compressor side 12 of the embodiment(s) of FIG. 2. The addition of the sub-cooling heat exchanger 52 in this manner, in the loop taken by the refrigerant 50 may allow larger temperature differences and higher efficiency.

Figure 5:
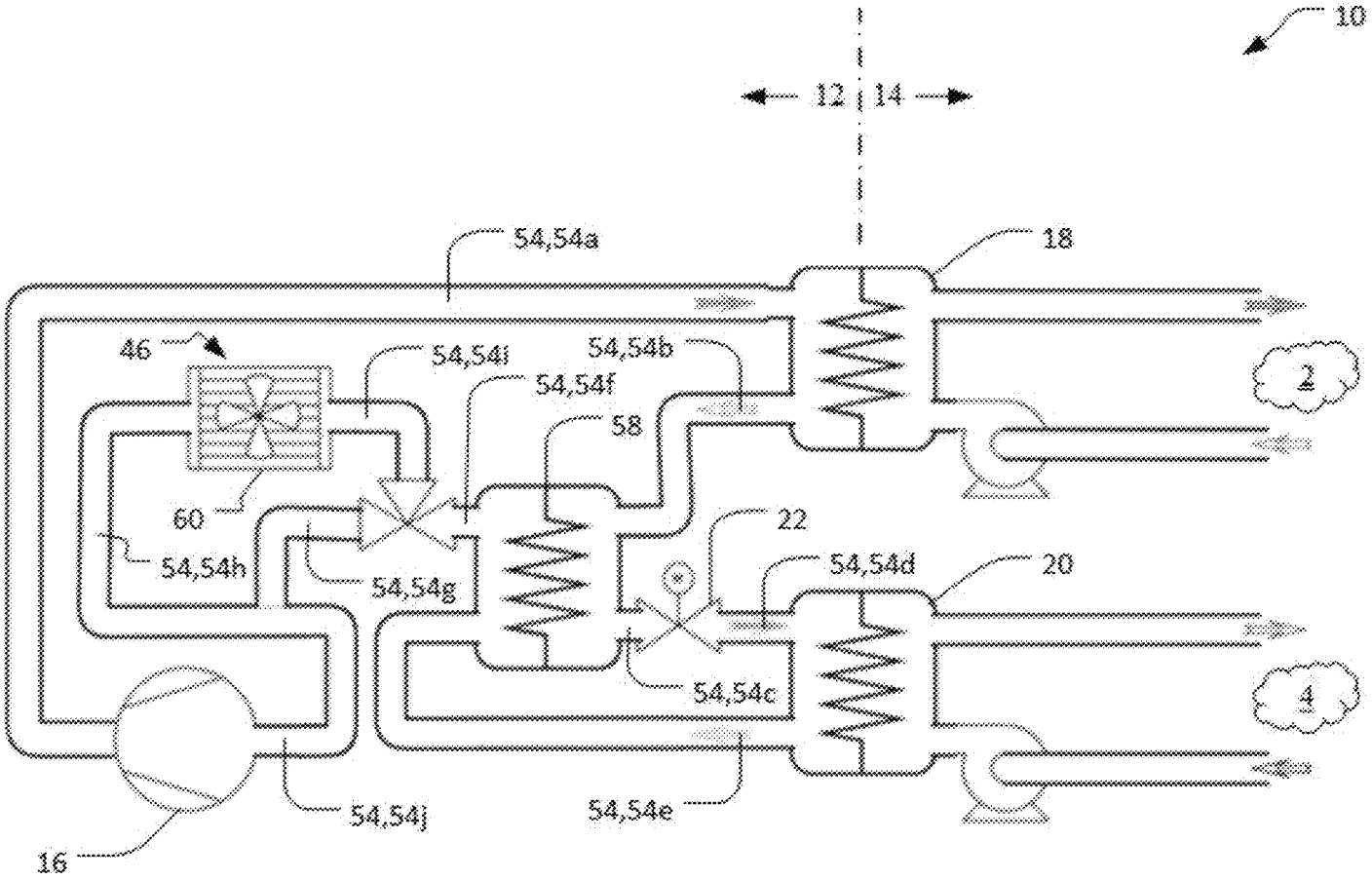
FIG. 5 is a schematic diagram of a heat pump system, wherein a sub-cooling heat exchanger is added to the compressor side of the embodiment of FIG. 1.

FIG. 5 is a schematic diagram of an alternate heat pump system in accord with the present invention, wherein alternate references for some elements are used to avoid confusion. Specifically, a refrigerant 54 (refrigerant portions 54*a-j*) replace the equivalent elements in the prior figures. Here a sub-cooling heat exchanger 58 (similar to the sub-cooling heat exchanger 52 in FIG. 4) and an additional heat exchanger 60 (similar to one of the heat exchangers 48,48*a-b* in FIG. 3) are added to the compressor side 12.

If the sub-cooling heat exchanger 58 is included in this manner, the refrigerant 54 returning to the compressor 16 may have excess or insufficient heat depending on the relative load on the heated process 2 and the chilled process 4 this allows a single additional heat exchanger 60 to either absorb or reject heat as needed using the circulating fluid 46 of consistent temperature.

Figure 6:
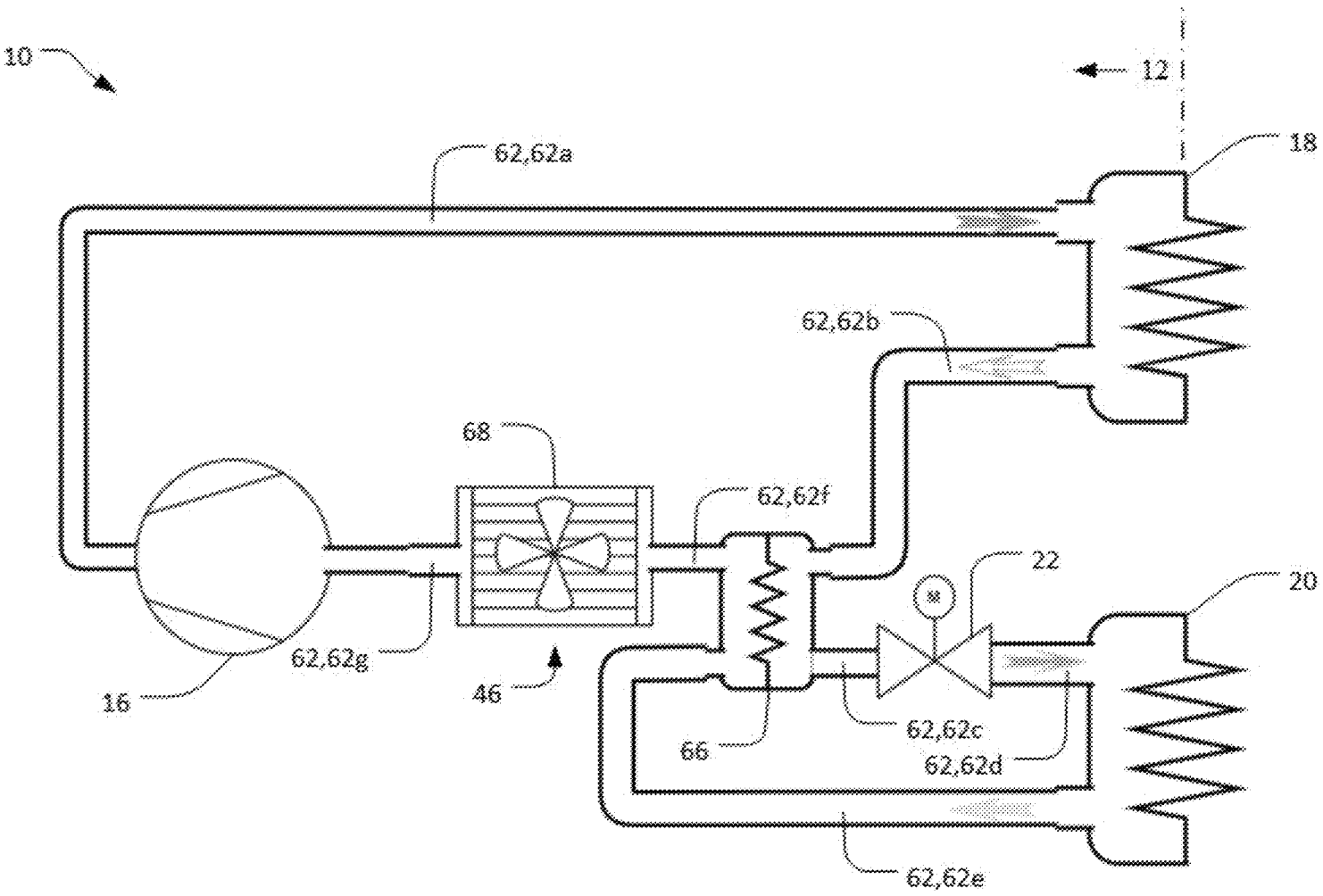
FIG. 6 is a schematic diagram of an alternate heat pump system in accord with the present invention, wherein a (in line) sub-cooling heat exchanger, a (in line) heat exchanger, and a circulating fluid to cool the latter heat exchanger are added.

FIG. 6 is a schematic diagram of an alternate heat pump system 10 in accord with the present invention, wherein alternate references for some elements are used to avoid confusion. Specifically, a refrigerant 62 (refrigerant portions 62*a-g*) replace the equivalent elements in the prior figures.

Here a sub-cooling heat exchanger 66 (similar to the sub-cooling heat exchangers in prior figures) and an additional heat exchanger 68 (similar to one of the additional heat exchangers in prior figures) are added to the compressor side 12, and the additional (in-line) heat exchanger 68 uses the circulating fluid 46 of consistent temperature.

Figure 7:
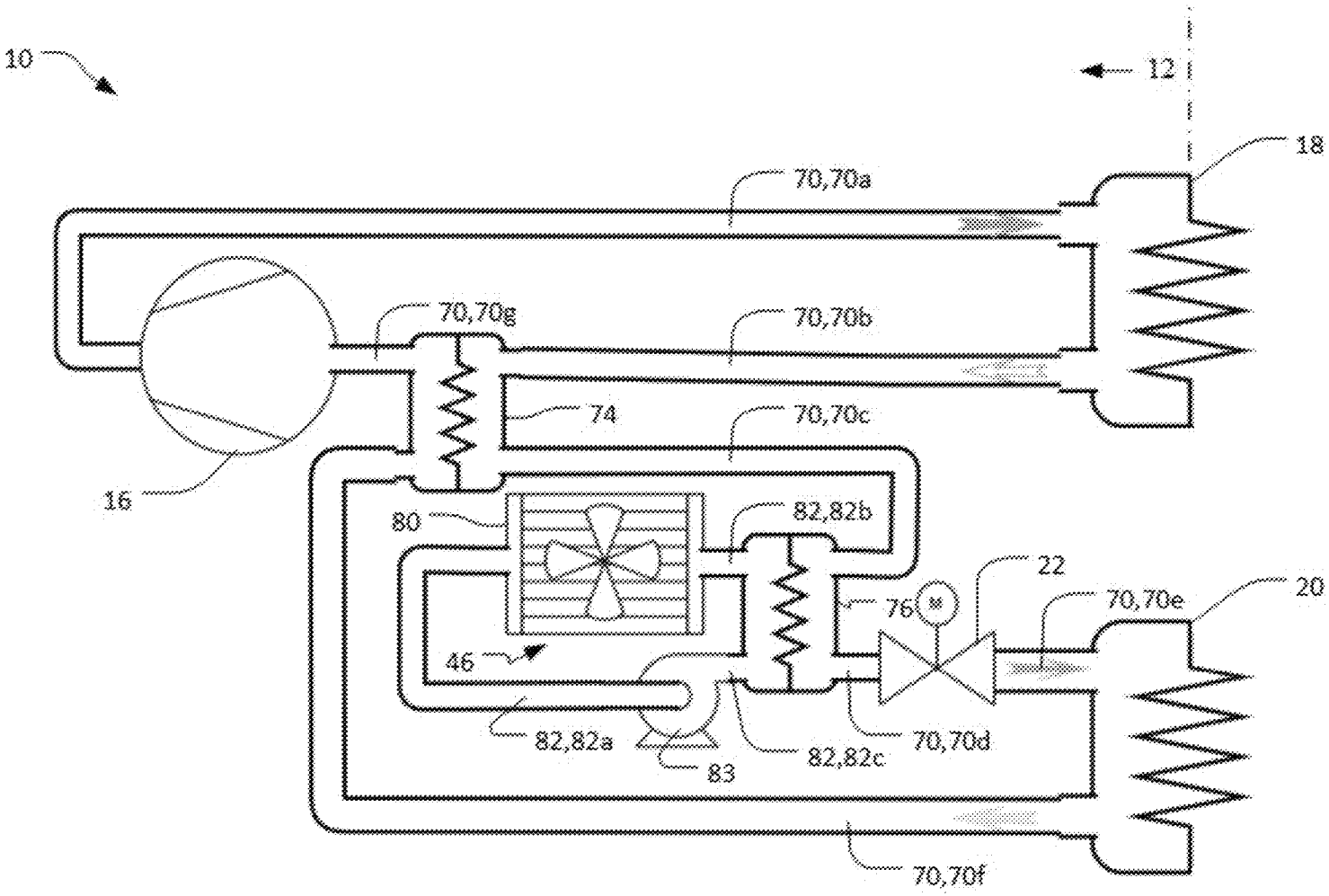
FIG. 7 is a schematic diagram of an alternate heat pump system, wherein two (in line) sub-cooling heat exchangers, a heat exchanger, and a circulating fluid to cool the latter heat exchanger are added.

FIG. 7 is a schematic diagram of an alternate heat pump system 10 in accord with the present invention, wherein alternate references for some elements are used to avoid confusion. Specifically, a refrigerant 70 (refrigerant portions 70*a-g*) replace the equivalent elements in the prior figures.

Here a first sub-cooling heat exchanger 74, a second sub-cooling heat exchanger 76, an additional heat exchanger 80 with a pump 83, and a cooling media 82 (cooling media portions 82*a-c*) are added to the compressor side 12. The additional heat exchanger 80 uses the circulating fluid 46 and circulates the cooling media 82 to extract head from the second sub-cooling heat exchanger 76.

Figure 8:
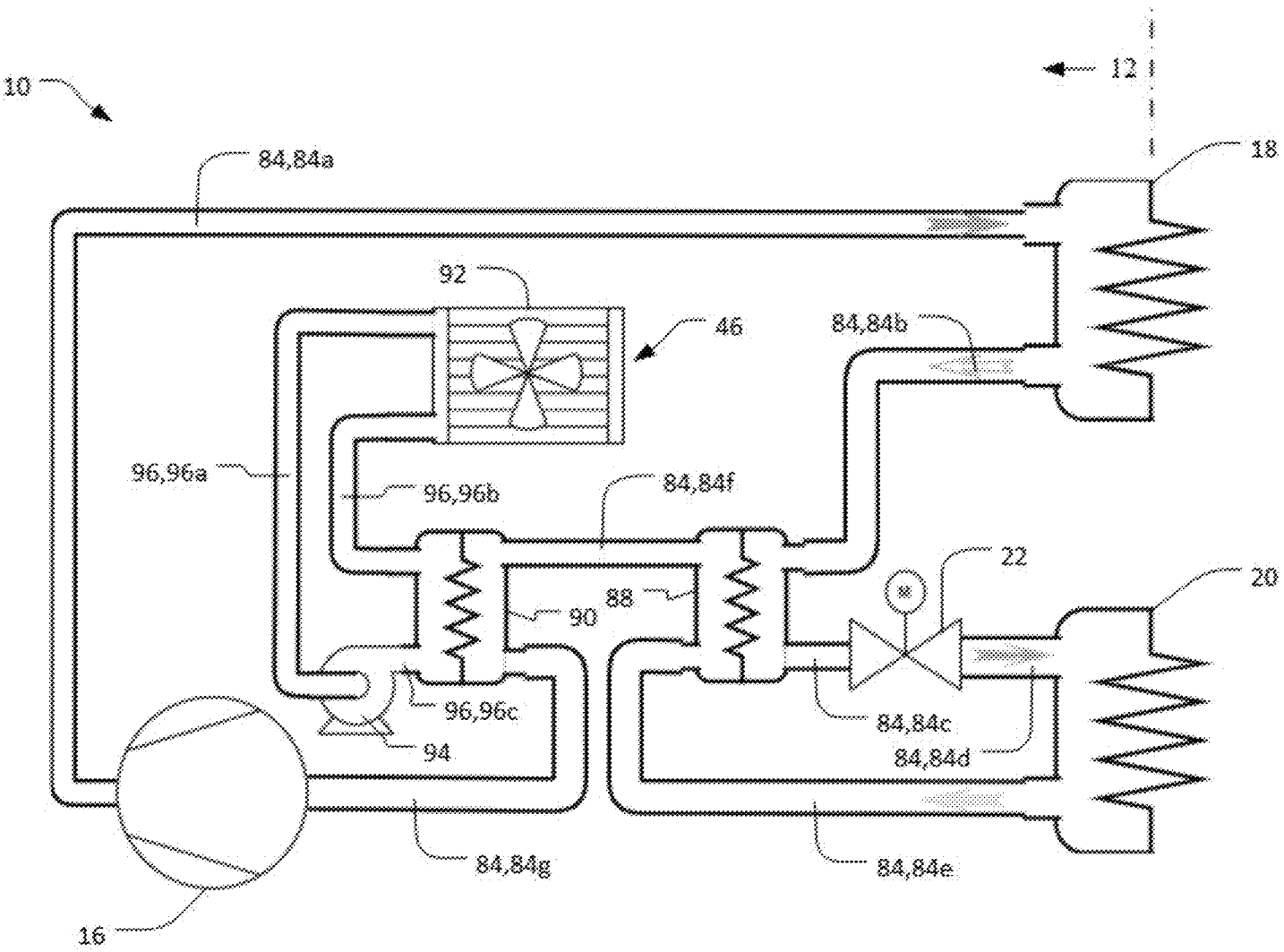
FIG. 8 is a schematic diagram of an alternate heat pump system, wherein two (in line) sub-cooling heat exchangers, a heat exchanger, and a circulating fluid to cool the latter heat exchanger are added in a different arrangement than in FIG. 7.

FIG. 8 is a schematic diagram of an alternate heat pump system 10 in accord with the present invention, wherein alternate references for some elements are used to avoid confusion. Specifically, a refrigerant 84 (refrigerant portions 84*a-g*) replace the equivalent elements in the prior figures.

Here a first sub-cooling heat exchanger 88, a second (in-line) sub-cooling heat exchanger 90, an additional heat exchanger 92 with a pump 94, and a cooling media 96 (cooling media portions 96*a-c*) are added to the compressor side 12. The additional heat exchanger 92 uses the circulating fluid 46 and circulates the cooling media 96 to extract head from the second sub-cooling heat exchanger 90.

Figure 9:
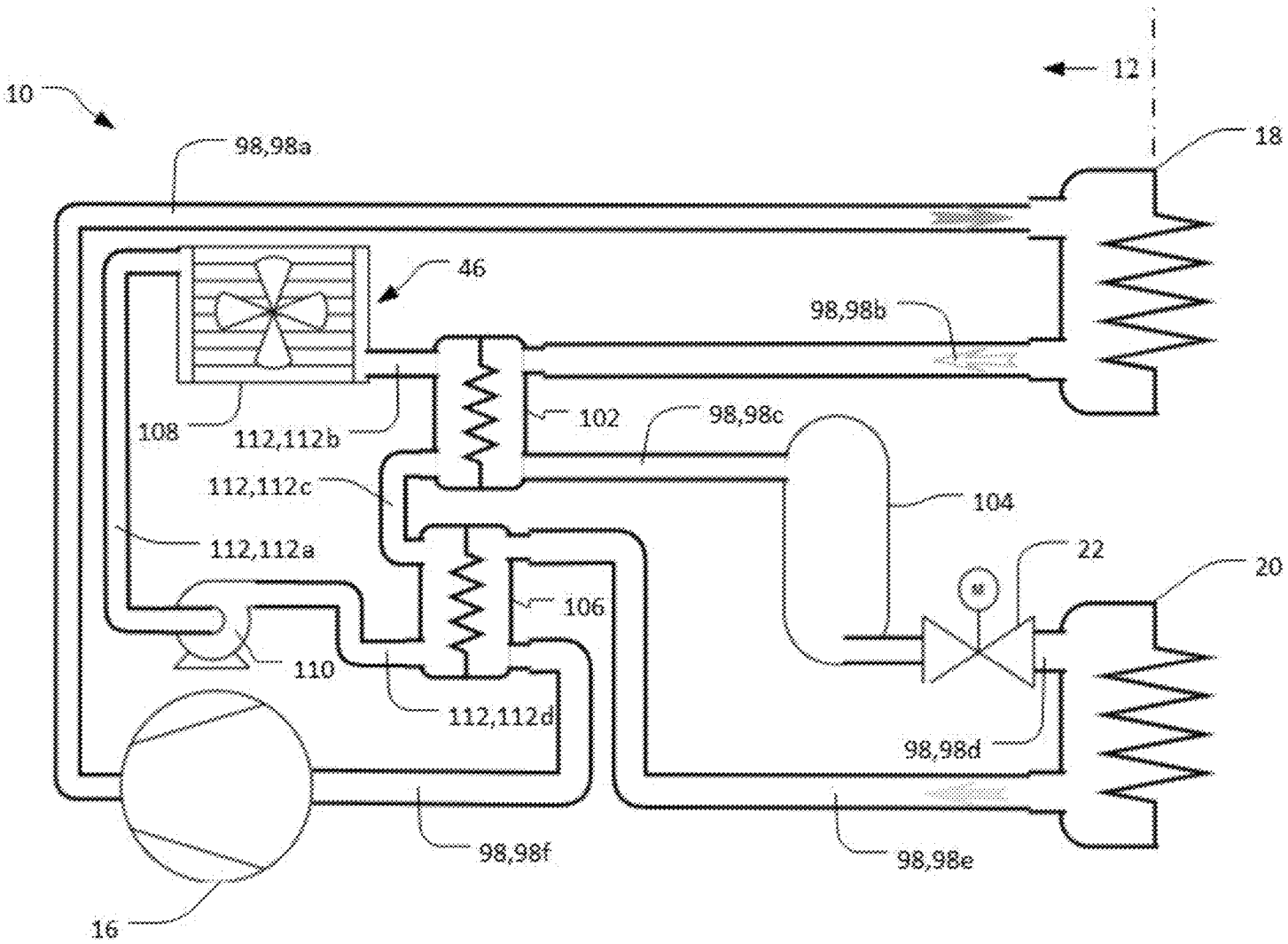
FIG. 9 is a schematic diagram of an alternate heat pump system, wherein two (in line) sub-cooling heat exchangers, a holding tank, a heat exchanger, and a circulating fluid to cool the latter heat exchanger are added.

FIG. 9 is a schematic diagram of alternate heat pump system 10 in accord with the present invention, wherein alternate references for some elements are used to avoid confusion. Specifically, a refrigerant 98 (refrigerant portions 98*a-f*) replace the equivalent elements in the prior figures.

Here a first (in-line) sub-cooling heat exchanger 102, a holding tank 104, a second (in-line) sub-cooling heat exchanger 106, an additional heat exchanger 108 with a pump 110, and a cooling media 112 (cooling media portions 112*a-d*) are added to the compressor side 12.

The additional heat exchanger 108 uses the circulating fluid 46 and circulates the cooling media 112 to extract head from the both the first (in-line) sub-cooling heat exchanger 102 and the second sub-cooling heat exchanger 106.

Figure 10:
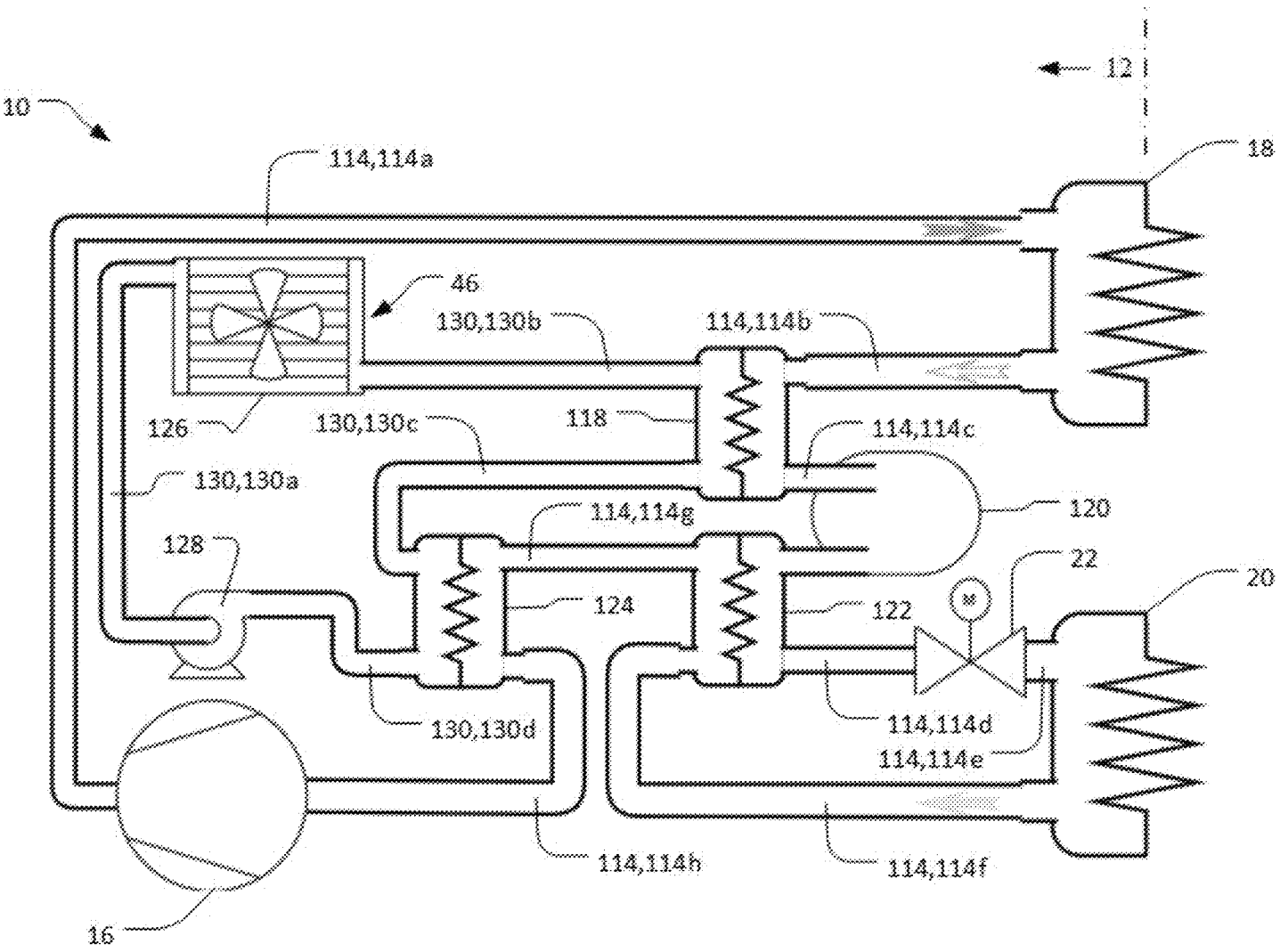
FIG. 10 is a schematic diagram of an alternate heat pump system, wherein three sub-cooling heat exchangers, a holding tank, a heat exchanger, and a circulating fluid to cool the latter heat exchanger are added.

FIG. 10 is a schematic diagram of alternate heat pump system 10 in accord with the present invention, wherein alternate references for some elements are used to avoid confusion. Specifically, a refrigerant 114 (refrigerant portions 114*a-h*) replace the equivalent elements in the prior figures.

Here a first (in-line) sub-cooling heat exchanger 118, a holding tank 120, a second (in-line) sub-cooling heat exchanger 122, a third (in-line) sub-cooling heat exchanger 124, an additional heat exchanger 126 with a pump 128, and a cooling media 130 (cooling media portions 130*a-d*) are added to the compressor side 12.

The additional heat exchanger 126 uses the circulating fluid 46 and circulates the cooling media 130 to extract head from both the first (in-line) sub-cooling heat exchanger 118 and the third sub-cooling heat exchanger 124.

Figure 11:
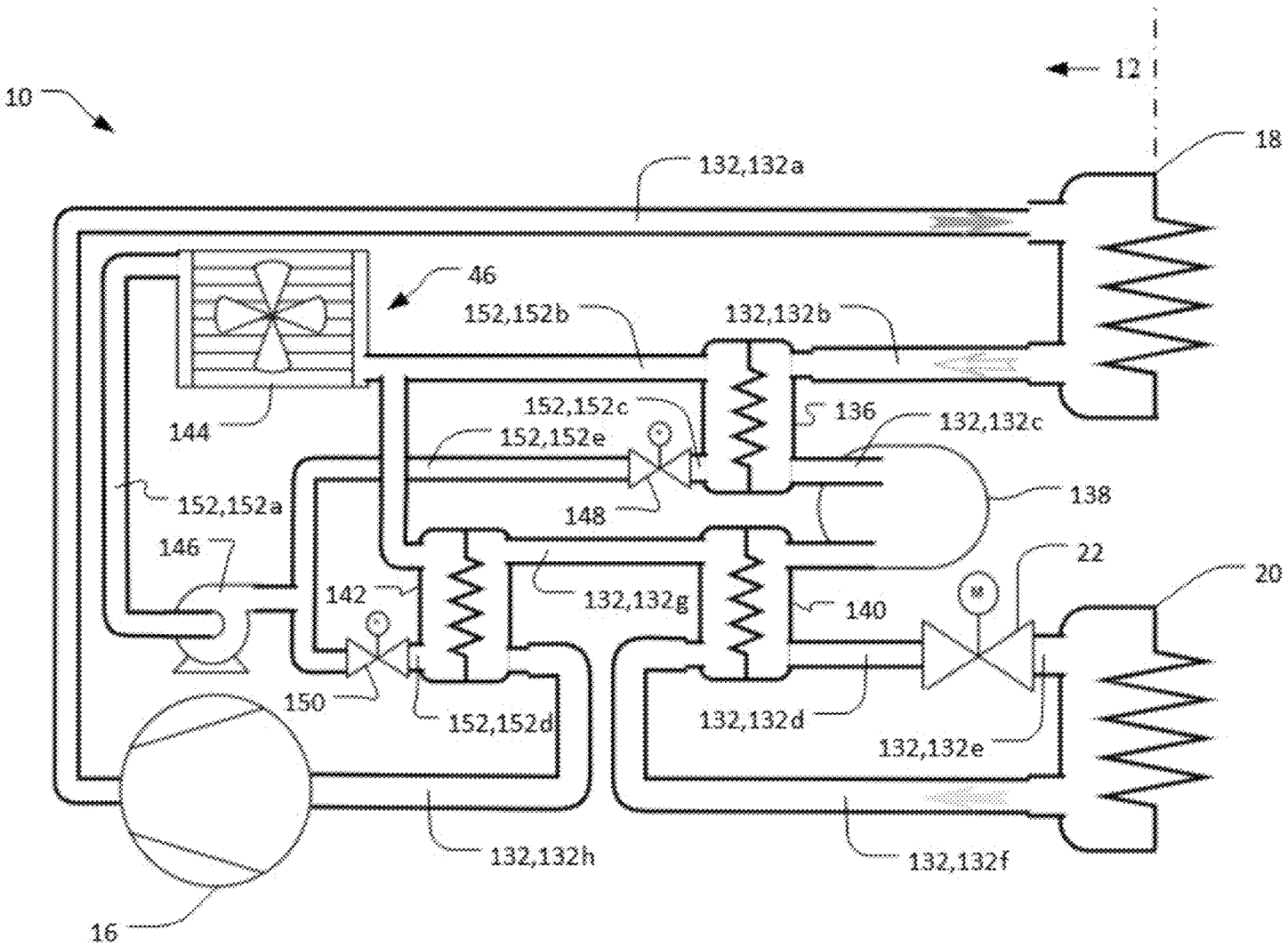
FIG. 11 is a schematic diagram of an alternate heat pump system, wherein additional elements and connection is employed over the embodiment in FIG. 10

FIG. 11 is a schematic diagram of alternate heat pump system 10 in accord with the present invention, wherein alternate references for some elements are used to avoid confusion. Specifically, a refrigerant 132 (refrigerant portions 132*a-h*) replace the equivalent elements in the prior figures.

Here a first (in-line) sub-cooling heat exchanger 136, a holding tank 138, a second (in-line) sub-cooling heat exchanger 140, a third (in-line) sub-cooling heat exchanger 142, an additional heat exchanger 144 with a pump 146, two additional secondary expansion devices 148,150 and a cooling media 152 (cooling media portions 152*a-e*) are added to the compressor side 12.

The additional heat exchanger 144 uses the circulating fluid 46 and circulates the cooling media 152 to extract head from both the first sub-cooling heat exchanger 136 and the third sub-cooling heat exchanger 142, while the additional secondary expansion devices 148,150 control flow of the cooling media 152.

While various embodiments have been described above, it should be understood that they have been presented by way of example only, and that the breadth and scope of the invention should not be limited by any of the above-described exemplary embodiments but should instead be defined only in accordance with the following claims and their equivalents.

What is claimed is:

1. A heat pump system (10) for supplying a heated process fluid (26,36) to a heated process (2) and for supplying a chilled process fluid (28,38) to a chilled process (4), comprising:

a compressor (16) to compress a refrigerant (24,34,44,50, 54,62,70,84,98,114, 132);

a hot heat exchanger (18) to receive the heated process fluid (26,36);

a cold heat exchanger (20) to receive the chilled process fluid (28,38);

an expansion device (22); and a heat exchanger (48*b*) able to receive a circulating fluid and a portion (44*j*) of said refrigerant (44) exiting said cold heat exchanger (20) and exchange energy therebetween before said refrigerant (44) enters said compressor (16);

wherein said compressor (16), said hot heat exchanger (18), said cold heat exchanger (20), and said expansion device (22) circulate said refrigerant (24,34,44,50,54, 62,70,84,98,114,132) in a first serial loop such that said hot heat exchanger (18) can impart heat energy into the heated process fluid (26,36) and concurrently said cold heat exchanger (20) can absorb heat energy from the chilled process fluid (28,38).

2. The heat pump system of claim 1, wherein said refrigerant is circulated as a gaseous refrigerant.

3. The heat pump system of claim 1, wherein the heated process fluid is water.

4. The heat pump system of claim 1, wherein the chilled process fluid is glycol.

5. The heat pump system of claim 1, further comprising:

a heat exchanger (40*a*) able to receive a circulating fluid (42) and the heated process fluid (36*b*) exiting the heated process (2) and exchange energy therebetween before the heated process fluid (36*b*) reenters said hot heat exchanger (18).

6. The heat pump system of claim 1, further comprising:

a heat exchanger (40*b*) able to receive a circulating fluid (42) and the chilled process fluid (38*b*) exiting the chilled process (4) and exchange energy therebetween before the chilled process fluid (38*b*) reenters said cold heat exchanger (20).

7. The heat pump system of claim 1, further comprising:

a heat exchanger (48*a*) able to receive a circulating fluid (46) and a portion (44*d*) of said refrigerant (44) exiting said hot heat exchanger (18) and exchange energy therebetween before said refrigerant (44) enters said expansion device (22).

8. The heat pump system of claim 1, further comprising:

a sub-cooling heat exchanger (52) to receive a first portion (50*b*) of said refrigerant (50) exiting said hot heat exchanger (18) before it enters said expansion device (20), to receive a second portion (50*e*) of said refrigerant (50) exiting said cold heat exchanger (20) before it enters said compressor (16), and to exchange energy between said first portion (50*b*) and said second portion (50*e*).

9. The heat pump system of claim 8, further comprising:

a heat exchanger (60) able to receive a circulating fluid (46) and a third portion (54*h*) of said refrigerant (54) exiting said sub-cooling heat exchanger (52) and exchange energy therebetween before said refrigerant (54) enters said compressor (16).

10. The heat pump system of claim 1, further comprising:

a sub-cooling heat exchanger (66); and a heat exchanger (68);

wherein:

said sub-cooling heat exchanger (66) receives a first portion (62*b*) of said refrigerant (62) exiting said hot heat exchanger (18) before it enters said expansion device (22);

said sub-cooling heat exchanger (66) receives a second portion (62*e*) of said refrigerant (62) exiting said cold heat exchanger (20) and exchanges energy between said first portion (62*b*) and said second portion (62*e*); and said heat exchanger (68) receives a circulating fluid (46) and said second portion (62*e*) and exchanges energy therebetween before said refrigerant (62) enters said compressor (16).

11. The heat pump system of claim 1, further comprising:

a first sub-cooling heat exchanger (74);

a second sub-cooling heat exchanger (76);

a pump (83) to circulate a cooling media (82);

a heat exchanger (80) to receive a circulating fluid (46); and wherein said first serial loop includes definable first through seventh portions (70*a-g*) of said refrigerant (70) in which:

said first portion (70*a*) is between said compressor (16) and said hot heat exchanger (18), said second portion (70*b*) is between said hot heat exchanger (18) and said first sub-cooling heat exchanger (74), said third portion (70*c*) is between said first sub-cooling heat exchanger (74) and said second sub-cooling heat exchanger (76), said fourth portion (70*d*) is between said second sub-cooling heat exchanger (76) and said expansion device (22), said fifth portion (70*e*) is between said expansion device (22) and said cold heat exchanger (20), said sixth portion (70*f*) is between said cold heat exchanger (20) and said first sub-cooling heat exchanger (74), and said seventh portion (70*g*) is between said first sub-cooling heat exchanger (74) and said compressor (16);

wherein said pump (83), said heat exchanger (80) and said second sub-cooling heat exchanger (76) circulate said cooling media (82) in a second serial loop that includes definable first through third segments (82*a-c*) of said cooling media (82) in which:

said first segment (82*a*) is between said pump (83) and said heat exchanger (80), said second segment (82*b*) is between said heat exchanger (80) and said second sub-cooling heat exchanger (76), and said third segment (80*c*) is between said second sub-cooling heat exchanger (76) and said pump (83); and thereby:

said first sub-cooling heat exchanger (74) imparts heat energy from said second portion (70*b*) into said seventh portion (70*g*) of said refrigerant (70), said second sub-cooling heat exchanger (76) imparts heat energy from said third portion (70*c*) of said refrigerant (70) into said second segment (82*b*) of said cooling media (82), and said heat exchanger (80) imparts heat energy from said cooling media (82) into said circulating fluid (46).

12. The heat pump system of claim 1, further comprising:

a first sub-cooling heat exchanger (88);

a second sub-cooling heat exchanger (90);

a pump (94) to circulate a cooling media (96);

a heat exchanger (92) to receive a circulating fluid (46); and wherein said first serial loop includes definable first through seventh portions (84*a-g*) of said refrigerant (84) in which:

said first portion (84*a*) is between said compressor (16) and said hot heat exchanger (18), said second portion (84*b*) is between said hot heat exchanger (18) and said first sub-cooling heat exchanger (88), said third portion (84*c*) is between said first sub-cooling heat exchanger (88) and said expansion device (22), said fourth portion (84*d*) is between said expansion device (22) and said cold heat exchanger (20), said fifth portion (84*e*) is between said cold heat exchanger (20) and said first sub-cooling heat exchanger (88), said sixth portion (84*f*) is between said first sub-cooling heat exchanger (74), and said second sub-cooling heat exchanger (90), and said seventh portion (84*g*) is between said second sub-cooling heat exchanger (90) and said compressor (16);

wherein said pump (94), said heat exchanger (92) and said second sub-cooling heat exchanger (90) circulate said cooling media (96) in a second serial loop that includes definable first through third segments (96*a-c*) of said cooling media (96) in which:

said first segment (96*a*) is between said pump (94) and said heat exchanger (92), said second segment (96*b*) is between said heat exchanger (92) and said second sub-cooling heat exchanger (90), and said third segment (96*c*) is between said second sub-cooling heat exchanger (90) and said pump (94); and thereby:

said first sub-cooling heat exchanger (88) imparts heat energy from said second portion (84*b*) into said fifth portion (84*e*) of said refrigerant (70), said second sub-cooling heat exchanger (90) imparts heat energy from said sixth portion (84*f*) of said refrigerant (70) into said second segment (96*b*) of said cooling media (96), and said heat exchanger (92) imparts heat energy from said cooling media (96) into said circulating fluid (46).

13. The heat pump system of claim 1, further comprising:

a first sub-cooling heat exchanger (102);

a holding tank (104);

a second sub-cooling heat exchanger (106);

a pump (110) to circulate a cooling media (112);

a heat exchanger (108) to receive a circulating fluid (46); and wherein said first serial loop includes definable first through sixth portions (98*a-f*) of said refrigerant (98) in which:

said first portion (98*a*) is between said compressor (16) and said hot heat exchanger (18), said second portion (98*b*) is between said hot heat exchanger (18) and said first sub-cooling heat exchanger (102), said third portion (98*c*) is between said first sub-cooling heat exchanger (102) and said expansion device (22), said fourth portion (84*d*) is between said expansion device (22) and said cold heat exchanger (20), said fifth portion (84*e*) is between said cold heat exchanger (20) and said second sub-cooling heat exchanger (106), and said sixth portion (84*f*) is between said second sub-cooling heat exchanger (106) and said compressor (16);

wherein said pump (110), said heat exchanger (108) and said first sub-cooling heat exchanger (102) circulate said cooling media (112) in a second serial loop that includes definable first through fourth segments (112*a-d*) of said cooling media (112) in which:

said first segment (112*a*) is between said pump (110) and said heat exchanger (108), said second segment (112*b*) is between said heat exchanger (108) and said first sub-cooling heat exchanger (102), said third segment (112*c*) is between said first sub-cooling heat exchanger (102) and said second sub-cooling heat exchanger (106), said fourth segment (112*d*) is between said second sub-cooling heat exchanger (106) and said pump (110); and thereby:

said first sub-cooling heat exchanger (102) imparts heat energy from said second portion (98*b*) of said refrigerant (70) into said third segment (112*c*) of said cooling media (112), said second sub-cooling heat exchanger (90) imparts heat energy from said fifth portion (98*e*) of said refrigerant (70) into said fourth segment (112*d*) of said cooling media (112), and said heat exchanger (108) imparts heat energy from said cooling media (112) into said circulating fluid (46).

14. The heat pump system of claim 1, further comprising:

a first sub-cooling heat exchanger (118);

a holding tank (120);

a second sub-cooling heat exchanger (122);

a third sub-cooling heat exchanger (124);

a pump (128) to circulate a cooling media (130);

a heat exchanger (126) able to receive a circulating fluid (46); and wherein said first serial loop includes definable first through eighth portions (114*a-h*) of said refrigerant (114) in which:

said first portion (114*a*) is between said compressor (16) and said hot heat exchanger (18), said second portion (114*b*) is between said hot heat exchanger (18) and said first sub-cooling heat exchanger (118), said third portion (114*c*) is between said first sub-cooling heat exchanger (118) and said second sub-cooling heat exchanger (122), said fourth portion (114*d*) is between said second sub-cooling heat exchanger (122) and said expansion device (22), said fifth portion (114*e*) is between said expansion device (22) and said cold heat exchanger (20), said sixth portion (114*f*) is between said cold heat exchanger (20) and said second sub-cooling heat exchanger (122), said seventh portion (114*g*) is between said second sub-cooling heat exchanger (106) and said third sub-cooling heat exchanger (124), and said eighth portion (114*g*) is between said third sub-cooling heat exchanger (124) and said compressor (16);

wherein said pump (128), said heat exchanger (126) and said third sub-cooling heat exchanger (124) circulate said cooling media (130) in a second serial loop that includes definable first through fourth segments (130*a-d*) of said cooling media (130) in which:

said first segment (130*a*) is between said pump (128) and said heat exchanger (126), said second segment (130*b*) is between said heat exchanger (126) and said first sub-cooling heat exchanger (118), said third segment (130*c*) is between said first sub-cooling heat exchanger (118) and said third sub-cooling heat exchanger (124), and said fourth segment (130*d*) is between said third sub-cooling heat exchanger (124) and said pump (128); and thereby:

said first sub-cooling heat exchanger (118) imparts heat energy from said second portion (114*b*) of said refrigerant (70) into said third segment (130*c*) of said cooling media (130), said second sub-cooling heat exchanger (122) imparts heat energy from said third portion (114C) into said seventh portion (114*g*) of said refrigerant (70), said third sub-cooling heat exchanger (124) imparts heat energy from said seventh portion (114*g*) of said refrigerant (70) into said fourth segment (112*d*) of said cooling media (112), and said heat exchanger (108) imparts heat energy from said cooling media (112) into said circulating fluid (46).

15. A heat pump system (10) for supplying a heated process fluid (26,36) to a heated process (2) and for supplying a chilled process fluid (28,38) to a chilled process (4), comprising:

a compressor (16) to compress a refrigerant (24,34,44,50, 54,62,70,84,98,114, 132);

a hot heat exchanger (18) to receive the heated process fluid (26,36);

a cold heat exchanger (20) to receive the chilled process fluid (28,38);

an expansion device (22);

a sub-cooling heat exchanger (52) to receive a first portion (50*b*) of said refrigerant (50) exiting said hot heat exchanger (18) before it enters said expansion device (20), to receive a second portion (50*e*) of said refrigerant (50) exiting said cold heat exchanger (20) before it enters said compressor (16), and to exchange energy between said first portion (50*b*) and said second portion (50*e*); and a heat exchanger (60) able to receive a circulating fluid (46) and a third portion (54*h*) of said refrigerant (54) exiting said sub-cooling heat exchanger (52) and exchange energy therebetween before said refrigerant (54) enters said compressor (16);

wherein said compressor (16), said hot heat exchanger (18), said cold heat exchanger (20), and said expansion device (22) circulate said refrigerant (24,34,44,50,54,62,70,84,98,114,132) in a first serial loop such that said hot heat exchanger (18) can impart heat energy into the heated process fluid (26,36) and concurrently said cold heat exchanger (20) can absorb heat energy from the chilled process fluid (28,38).

16. The heat pump system of claim 15, wherein said refrigerant is circulated as a gaseous refrigerant.

17. The heat pump system of claim 15, wherein the heated process fluid is water.

18. The heat pump system of claim 16, wherein the chilled process fluid is glycol.

19. The heat pump system of claim 15, further comprising:

a heat exchanger (40*a*) able to receive a circulating fluid (42) and the heated process fluid (36*b*) exiting the heated process (2) and exchange energy therebetween before the heated process fluid (36*b*) reenters said hot heat exchanger (18).

20. The heat pump system of claim 15, further comprising:

a heat exchanger (40*b*) able to receive a circulating fluid (42) and the chilled process fluid (38*b*) exiting the chilled process (4) and exchange energy therebetween before the chilled process fluid (38*b*) reenters said cold heat exchanger (20).

* * * * *